US011060229B2

(12) United States Patent
Kim et al.

(10) Patent No.: US 11,060,229 B2
(45) Date of Patent: Jul. 13, 2021

(54) CLOTH-TREATING APPARATUS

(71) Applicant: LG Electronics Inc., Seoul (KR)

(72) Inventors: Keunjoo Kim, Seoul (KR); Kyosoon Chae, Seoul (KR); Jaeyong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 265 days.

(21) Appl. No.: 15/568,942

(22) PCT Filed: Apr. 27, 2016

(86) PCT No.: PCT/KR2016/004413
§ 371 (c)(1),
(2) Date: Oct. 24, 2017

(87) PCT Pub. No.: WO2016/175557
PCT Pub. Date: Nov. 3, 2016

(65) Prior Publication Data

US 2018/0119327 A1 May 3, 2018

(30) Foreign Application Priority Data

Apr. 27, 2015 (KR) ..... 10-2015-0058983
Apr. 27, 2015 (KR) ..... 10-2015-0058984
Apr. 27, 2016 (KR) ..... 10-2016-0051336

(51) Int. Cl.
*D06F 37/26* (2006.01)
*D06F 31/00* (2006.01)
(Continued)

(52) U.S. Cl.
CPC ..... *D06F 37/26* (2013.01); *D06F 31/00* (2013.01); *D06F 37/24* (2013.01); *D06F 37/12* (2013.01); *D06F 37/245* (2013.01); *D06F 39/08* (2013.01)

(58) Field of Classification Search
CPC ..... D06F 37/26; D06F 37/24; D06F 37/12; D06F 23/04; D06F 39/14; D06F 31/00; D06F 29/00
(Continued)

(56) References Cited

U.S. PATENT DOCUMENTS 3,324,688 A * 6/1967 Hubbard ..... D06F 13/00 68/4
3,481,162 A * 12/1969 Ziegler ..... D06F 13/00 68/4
(Continued)

FOREIGN PATENT DOCUMENTS

CN 1782196 6/2006
CN 1782196 A * 6/2006
(Continued)

OTHER PUBLICATIONS

Maeng et al.; "Barrelhead of washing machine" Jun. 2006, CN-1782196-A—Machine Translation (Year: 2006).*
(Continued)

*Primary Examiner* — David G Cormier
*Assistant Examiner* — Thomas Bucci
(74) *Attorney, Agent, or Firm* — Fish & Richardson P.C.

(57) ABSTRACT

The present invention relates to a cloth-treating apparatus comprising: a cabinet which forms an exterior; a tub, provided inside the cabinet, for accommodating wash water; a drum which is rotatably provided inside the tub; and an auxiliary vessel which is detachably provided inside the drum and in which washing of laundry is conducted separately from the drum, wherein the auxiliary vessel comprises a discharge part for discharging, to the upper portion, wash water accommodated in the auxiliary vessel by means of centrifugal force due to rotation.

18 Claims, 9 Drawing Sheets

(51) Int. Cl.
*D06F 37/24* (2006.01)
*D06F 39/08* (2006.01)
*D06F 37/12* (2006.01)

(58) Field of Classification Search
USPC ..... 68/200, 4, 27, 196, 207, 23.5, 3 R, 23.2, 68/13 R, 18 FA, 208, 23.3, 174, 23 R; 312/228
See application file for complete search history.

(56) References Cited

U.S. PATENT DOCUMENTS

| | | | | |
|---|---|---|---|---|
| 3,509,741 | A * | 5/1970 | Morey | D06F 37/12 68/27 |
| 3,575,020 | A * | 4/1971 | Hubbard | D06F 13/00 68/4 |
| 7,866,191 | B2 * | 1/2011 | Turner | D06F 37/266 68/12.06 |
| 9,404,213 | B2 * | 8/2016 | Kappler | D06F 58/30 |
| 2007/0084254 | A1 * | 4/2007 | Messina | D06F 95/002 68/142 |
| 2008/0168803 | A1 * | 7/2008 | Muyskens | D06F 39/001 68/23.3 |
| 2011/0094902 | A1 * | 4/2011 | Delehey | D06F 95/002 206/216 |
| 2015/0059417 | A1 * | 3/2015 | Ramasco | D06F 39/022 68/17 A |
| 2015/0184326 | A1 * | 7/2015 | Seo | D06F 37/20 68/132 |
| 2015/0211163 | A1 * | 7/2015 | Kim | D06F 17/10 68/133 |
| 2016/0201243 | A1 * | 7/2016 | Bergamo | D06F 37/12 8/137 |
| 2016/0222567 | A1 * | 8/2016 | Ramasco | D06F 95/002 |

FOREIGN PATENT DOCUMENTS

| | | |
|---|---|---|
| JP | 2005006689 | 1/2005 |
| KR | 10-2003-0045447 | 1/2005 |
| KR | 100539506 | 2/2006 |
| KR | 10-2011-0019215 | 2/2011 |
| KR | 10-2015-0030806 | 3/2015 |

OTHER PUBLICATIONS

International Search Report in International Application No. PT/KR2016/004413, dated Aug. 13, 2016, 66 pages (with English translation).
Chinese Office Action in Chinese Application No. 201680024345.8, dated Jul. 23, 2019, 12 pages (with English translation).

* cited by examiner

FIG. 3
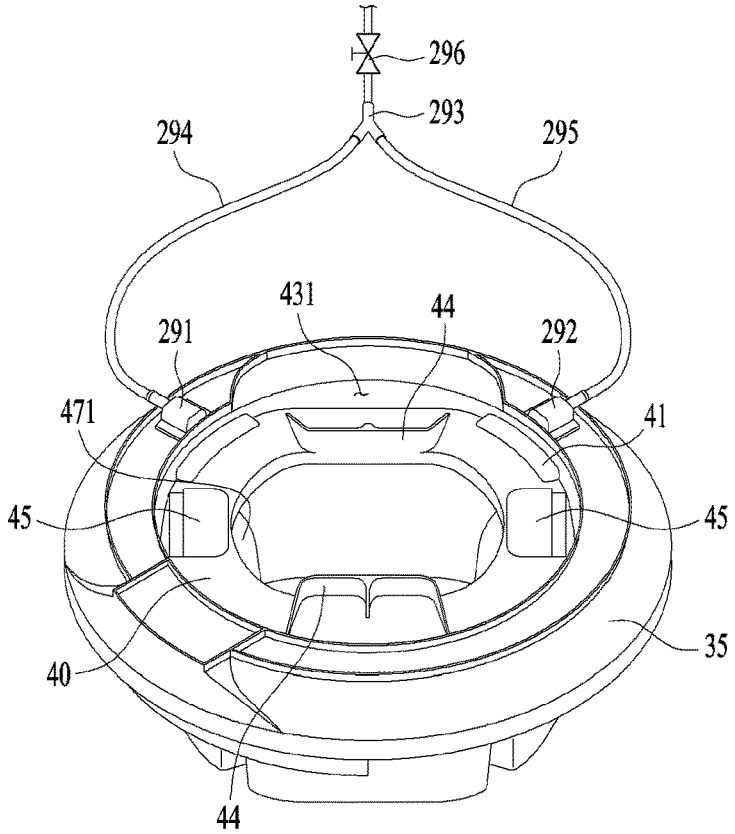
(a)
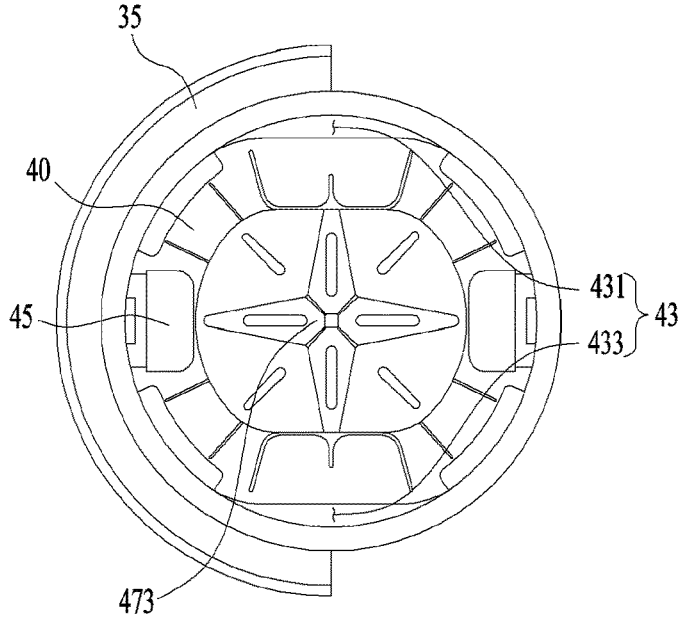
(b)

CLOTH-TREATING APPARATUS

CROSS-REFERENCE TO RELATED APPLICATIONS

This application is a National Stage application under 35 U.S.C. § 371 of International Application No. PCT/KR2016/004413, filed Apr. 27, 2016, which claims priority under 35 U.S.C. § 119(a) to Korean Application No. 10-2016-0051336, filed on Apr. 27, 2016, Korean Application No. 10-2015-0058984, filed on Apr. 27, 2015, and Korean Application No. 10-2015-0058983, filed on Apr. 27, 2015. The disclosures of the prior applications are incorporated by reference in their entirety.

TECHNICAL FIELD

The present invention relates to a laundry treatment apparatus.

BACKGROUND ART

A laundry treatment apparatus conceptually includes a washing apparatus that washes laundry and a drying apparatus that dries the laundry that has been washed by the washing apparatus In the case in which a laundry treatment apparatus is used as a washing apparatus, the laundry treatment apparatus may include a cabinet defining the external appearance thereof, a tub provided in the cabinet to receive wash water, a drum rotatably provided in the cabinet to receive laundry, and a door provided at the front of the cabinet to allow laundry to be introduced thereinto and removed therefrom.

Generally, a laundry treatment apparatus may be classified as a top loading type laundry treatment apparatus, which is configured such that the shaft of a drum is perpendicular to the ground, or a front loading type laundry treatment apparatus, which is configured such that the shaft of a drum is parallel to the ground.

In a conventional laundry treatment apparatus, wash water is supplied into a tub, and the wash water, supplied into the tub, is supplied into a drum via through-holes provided in the outer circumferential surface of the drum to allow communication between the inside and the outside of the drum.

Some laundry needs to be washed separately depending on the color, kind, and size of laundry. To this end, it is necessary for the conventional laundry treatment apparatus to further include a sub drum provided in a main drum so as to be rotatable with the main drum.

Also, in the case in which wash water is supplied into the sub drum and the wash water overflowing from the sub drum is supplied to the main drum, laundry received in the main drum may be contaminated by the wash water overflowing from the sub drum.

In addition, wash water is not simultaneously supplied into the main drum and the sub drum, which increases washing time.

In addition, a water drainage structure for draining wash water received in the sub drum is not provided, whereby the wash water is lost.

In addition, the sub drum provided in the main drum is not fixed but moves relative to the main drum, whereby noise is generated.

Meanwhile, a structure for draining wash water supplied into the sub drum may be classified as an upper water drainage structure and a lower water drainage structure.

The lower water drainage structure may include a water drainage port formed in the lower part of the sub drum and a door for selectively closing the water drainage port. In the case in which the lower water drainage structure is adopted for the sub drum, the door is controlled to be closed in order to preserve wash water during a washing cycle and controlled to be opened in order to drain wash water at a water drainage step of a rinsing cycle or a spin-drying cycle after the washing cycle is completed.

In the upper water drainage structure, no additional door to be controlled is needed. The upper water drainage structure may include an outlet hole formed in the upper end of the sub drum. In the case in which the upper water drainage structure is adopted for the sub drum, a simple structure is achieved since no additional device to be controlled, such as a door, is needed.

In the upper water drainage structure, however, it is not easy to preserve wash water during a washing cycle and to drain wash water at a water drainage step of a rinsing cycle or a spin-drying cycle after the washing cycle is completed.

Also, it is necessary to provide an appropriate water drainage path in order to solve a problem in which laundry received in the main drum is contaminated by wash water drained from the sub drum at a water drainage step of a rinsing cycle or a spin-drying cycle after the washing cycle is completed.

DISCLOSURE

Technical Problem

It is an object of the present invention to provide a laundry treatment apparatus including a second drum provided in a first drum so as to be rotatable with the first drum in order to wash laundry separately depending on the kind of laundry.

It is another object of the present invention to provide a laundry treatment apparatus including an additional water supply device such that, in a structure in which wash water is supplied to a second drum and the wash water overflowing from the second drum is supplied to a first drum, laundry received in the first drum is prevented from being contaminated by the wash water overflowing from the second drum.

It is another object of the present invention to provide a laundry treatment apparatus including a water supply device capable of simultaneously supplying wash water to a first drum and a second drum.

It is another object of the present invention to provide a laundry treatment apparatus including a water drainage structure for draining wash water from a second drum, thereby preventing the loss of wash water.

It is another object of the present invention to provide a laundry treatment apparatus including a fixing unit to fix a second drum provided in a first drum, thereby preventing noise from being generated from the second drum.

It is a further object of the present invention to provide a laundry treatment apparatus including an appropriate water drainage path to prevent laundry received in a first drum from being contaminated by wash water drained from a second drum at a water drainage step.

Technical Solution

In accordance with an aspect of the present invention, the above and other objects can be accomplished by the provision of a laundry treatment apparatus including a cabinet defining the exterior appearance thereof, a water supply unit configured to supply wash water, a tub provided in the cabinet to receive wash water, a first drum rotatably provided in the tub to receive laundry, and a second drum mounted in the first drum so as to be rotatable with the first drum, wherein the water supply unit supplies wash water to the first drum and the second drum independently.

The second drum may be detachable from the first drum.

The water supply unit may include a first water supply unit configured to supply the wash water to the first drum and a second water supply unit configured to supply the wash water to the second drum.

The cross section of the second drum may be formed in an oval shape.

The laundry treatment apparatus may further include a water supply path formed between the first drum and the second drum and guiding the wash water supplied from the first water supply unit toward the second drum.

The cross section of the first drum may be formed in a circular shape and the cross section of the second drum may be formed in an oval shape, and the water supply path may be formed between the two cross sections.

The laundry treatment apparatus may further include a water drainage path configured to drain the wash water supplied to the second drum outside the first drum.

The water drainage path may be provided on the upper surface of the first drum.

The second drum may further include a handle unit provided at each end of a major axis of the cross section of the second drum and providing a space for a user to hold.

The second drum may further include a first fixing unit provided in each end of the major axis of the cross section and preventing the second drum from separating from the first drum.

The second drum may further include a second fixing unit protruding to a preset height from the outer circumferential surface of the second drum and preventing the second drum from moving horizontally when mounted in the first drum.

The cross section of the second fixing unit may be formed in a trapezoidal shape.

The length of the upper surface of the handle unit may be shorter than the length of the lower surface thereof to thus form a step.

In accordance with another aspect of the present invention, there is provided a laundry treatment apparatus including a cabinet defining the exterior appearance thereof, a tub provided in the cabinet to receive wash water, a first drum rotatably provided in the tub to receive laundry, a first water supply unit supplying the wash water to the first drum, and a second drum mounted in the first drum so as to be rotatable with the first drum, wherein the second drum includes a body configured to receive the laundry, a water supply guide provided in one surface of the body and preventing the wash water supplied to the first drum from flowing into the body, a second water supply unit configured to supply the wash water to the body, and a second drum water drainage unit configured to drain the wash water from the body to the tub.

The cross section of the body may be formed in an oval shape.

The second drum may be detachable from the first drum.

The second drum may include at least one handle unit to detach the second drum from the first drum.

The body may include a first fixing unit for preventing the second drum from vertically separating from the first drum in the state in which the second drum is fixedly mounted in the first drum.

The first fixing unit may be located on the same line of longitude as the handle unit.

The first fixing unit may have a hook structure.

The body may include a second fixing unit for preventing the second drum from horizontally separating from the first drum in the state in which the second drum is fixedly mounted in the first drum.

The second fixing unit may protrude to a preset height from the body along the outer circumference of the body.

The longitudinal section of the second fixing unit may be formed in a trapezoidal shape.

The longitudinal section of the second fixing unit is formed in a rectangular shape.

The second water supply unit may control the amount of wash water supplied to the second drum by controlling the amount of time the wash water is supplied to the second drum.

At least one second water supply unit may be provided, and the water pressure of the wash water flowing in the second water supply unit may be constant.

The second drum water drainage unit may include at least one collection portion provided in the inner circumferential surface of the top side of the body and collecting the wash water held in the body, at least one inlet hole provided in the lower surface of the collection portion and allowing the wash water to flow therein, and at least one outlet hole provided in an upper surface of the collection portion and allowing the wash water collected in the collection portion to be discharged therefrom.

The inlet hole and the outlet hole may be provided on different lines of longitude.

The collection portion may include a first collection portion provided in the body and a second collection portion provided in the upper surface of the first collection portion and communicating with the outlet hole in the first collection portion.

The second collection portion may include a slit provided in the upper surface of the second collection portion and providing a certain space for discharging the wash water to the tub.

The slit may be detachable.

Both lateral surfaces of the body may be inclined at a preset angle to allow the wash water inside the body to flow to the collection portion.

The body may include a first rib protruding upward from a lower surface of the body and a second rib protruding toward the center of the body from the inner lateral surface of the body.

In accordance with another aspect of the present invention, there is provided a laundry treatment apparatus including a cabinet defining the exterior appearance thereof, a tub provided in the cabinet to receive wash water, a drum rotatably provided in the tub, and a second drum detachably provided in the drum to wash laundry in the state of being separated from the drum, wherein the second drum includes a discharge hole to discharge wash water received in the second drum upward using centrifugal force generated by rotation of the second drum.

The laundry treatment apparatus may further include a first water drainage path defined between the tub and the drum and a second water drainage path defined between the drum and the second drum, wherein the discharge hole may drop wash water to at least one of the first and second water drainage paths using the centrifugal force generated by the rotation of the second drum.

The second drum may be rotated by rotational force of the drum in the state of being coupled to the drum.

The laundry treatment apparatus may further include a tub cover detachably coupled to the upper end of the tub, wherein the first water drainage path may further include a flow path defined between the tub cover and the drum.

The second drum may be detachably coupled to the inner circumferential surface of the upper end of the drum, and the second water drainage path may be formed by recessing a portion of the inner circumferential surface of the upper end of the drum and may extend to the lower side of the drum.

The discharge hole may be provided at the upper end of the second drum to discharge wash water that moves upward while circulating along the inner circumferential surface of the second drum due to the rotation of the second drum.

The discharge hole may include at least one outlet hole formed through the circumferential surface of the second drum.

The laundry treatment apparatus may further include a scattering prevention unit provided at the upper side of the outlet hole to prevent wash water discharged from the discharge hole from scattering upward.

The laundry treatment apparatus may further include a tub cover detachably coupled to the upper end of the tub, wherein the scattering prevention unit may extend from the tub cover toward the second drum.

The scattering prevention unit may protrude from the outer circumferential surface of the second drum.

The laundry treatment apparatus may further include a scattered water collection unit to guide wash water collected at the lower surface of the scattering prevention unit to the second water drainage path.

The scattered water collection unit may include at least one rib provided at the lower surface of the scattering prevention unit and having one surface that faces the discharged unit.

The upper end of the second drum may be detachably coupled to the drum, and the upper end of the second drum may include a coupling portion coupled to the drum and a spacing portion spaced apart from the drum.

The discharge hole may be provided at the coupling portion.

The second water drainage path may be formed at one side of the inner circumferential surface of the drum that faces the coupling portion.

The drum may include a balancer provided along the circumferential surface of the upper end of the drum, and the second water drainage path may be formed by recessing one side of the inner circumferential surface of the balancer.

The second drum may include an auxiliary body to receive laundry and wash water and an auxiliary cover detachably provided at the auxiliary body and having a laundry introduction port through which laundry is introduced.

The cabinet may be provided in the upper surface thereof with an opening through which laundry is introduced.

The drum may include a first concave-convex unit provided in the inner circumferential surface of the drum, and the second drum may further include a second concave-convex unit provided in the outer circumferential surface of the second drum so as to engage with the first concave-convex unit.

The second drum may include a first rib protruding upward from the lower surface of the second drum and a second rib protruding from the inner circumferential surface of the second drum toward the inside of the second drum.

In accordance with another aspect of the present invention, there is provided a laundry treatment apparatus including a cabinet defining the exterior appearance thereof, a tub provided in the cabinet to receive wash water, a drum rotatably provided in the tub, and a second drum detachably provided in the drum to wash laundry in the state of being separated from the drum, wherein the second drum container includes a nozzle unit to adjust an angle at which wash water is discharged using centrifugal force generated by rotation the second drum.

The laundry treatment apparatus may further include a tub cover detachably coupled to the upper end of the tub, wherein the nozzle unit may discharge wash water toward the inner surface of the tub cover.

The tub cover may include a bent cover portion provided at the upper end of the tub and bent to the inside of the tub and a horizontal cover portion extending from the bent cover portion to the inside of the tub and having an opening formed in the center thereof.

The nozzle unit may be configured to discharge wash water toward the lower surface of the horizontal cover portion.

The angle at which the wash water is discharged may be adjusted such that an incidence angle of the wash water on the lower surface of the horizontal cover portion is an acute angle.

The nozzle unit may be provided so as to be higher than the upper end of the drum and to be lower than the horizontal cover portion.

The laundry treatment apparatus may further include a scattering prevention unit provided at the upper side of the nozzle unit to prevent wash water discharged from the nozzle unit from scattering upward.

The laundry treatment apparatus may further include a tub cover detachably coupled to the upper end of the tub, wherein the scattering prevention unit may extend from the tub cover toward the second drum.

The scattering prevention unit may include a curved blocking portion having a predetermined curvature.

The scattering prevention unit may include a horizontal blocking portion extending from the tub cover to the inside of the tub and a bent blocking portion coupled to the horizontal blocking portion and bent downward toward the second drum.

The scattering prevention unit may protrude from the outer circumferential surface of the second drum.

The nozzle unit may be provided at the upper end of the second drum to discharge wash water that moves upward while circulating along the inner circumferential surface of the second drum due to the rotation of the second drum.

The nozzle unit may include at least one outlet hole formed through the circumferential surface of the second drum.

The outlet hole may include a nozzle inlet port formed in one side thereof to introduce wash water and a nozzle outlet port formed in the other side thereof to discharge the wash water introduced through the nozzle inlet port and configured to be smaller than the nozzle inlet port.

The second drum may include an inclined portion provided at the lower side of the nozzle unit and protruding from the inner circumferential surface of the second drum such that wash water is introduced toward the nozzle unit while maintaining a predetermined inclination angle.

The inclined portion may include a first inclined portion formed so as to be inclined upward toward the inside of the second drum and a second inclined portion connected to the upper end of the first inclined portion and formed so as to be inclined upward toward the outside of the second drum.

The upper end of the second drum may be detachably coupled to the drum, and the upper end of the second drum may include a coupling portion coupled to the drum and a spacing portion spaced apart from the drum.

The nozzle unit may be provided at the coupling portion.

The cabinet may be provided in the upper surface thereof with an opening through which laundry is introduced.

The second drum may include an auxiliary body to receive laundry and wash water and an auxiliary cover detachably provided at the auxiliary body and having a laundry introduction port through which laundry is introduced.

The drum may include a first concave-convex unit provided in the inner circumferential surface of the drum, and the second drum may further include a second concave-convex unit provided in the outer circumferential surface of the second drum so as to engage with the first concave-convex unit.

The second drum may include a first rib protruding upward from the lower surface of the second drum and a second rib protruding from the inner circumferential surface of the second drum toward the inside of the second drum.

In accordance with a further aspect of the present invention, there is provided a laundry treatment apparatus including a cabinet defining the exterior appearance thereof, a tub provided in the cabinet to receive wash water, a drum rotatably provided in the tub, and a second drum detachably provided in the drum to wash laundry in the state of being separated from the drum, wherein the second drum includes a decompression unit to decompress wash water received in the second drum before the wash water is discharged using centrifugal force generated by rotation of the second drum.

The decompression unit may include a plurality of collection portions to sequentially collect the wash water and a plurality of through-holes through which the collection portions communicate with each other such that wash water sequentially passes through the collection portions while moving upward due to the rotation of the second drum.

The through-holes may be provided on different lines of longitude.

The sizes of the through-holes may be sequentially reduced in the order in which wash water passes through the through-holes.

The sizes of the collection portions may be sequentially reduced in the order in which wash water passes through the collection portions.

The decompression unit may include an inlet hole through which a lowermost one of the collection portions communicates with the interior of the second drum, and the inlet hole may be provided on a different line of longitude than some of the through-holes.

The decompression unit may further include a decompression path to downwardly move the wash water that has passed through the collection portions.

The decompression unit may include a first slit through which an uppermost one of the collection portions communicates with the decompression path and a second slit through which the decompression path communicates with the outside of the second drum.

The decompression unit may include a rising flow path to move wash water upward and a falling flow path to downwardly move the wash water that has moved upward.

The falling flow path may be narrower than the rising flow path.

The decompression unit may include a water wall including one surface that defines one side of the rising flow path and the other surface that is provided so as to be opposite the one surface and defines one side of the falling flow path.

The laundry treatment apparatus may further include a plurality of collection portions to sequentially collect wash water while the wash water moves upward along the rising flow path and a plurality of through-holes through which the collection portions communicate with each other such that wash water sequentially passes through the collection portions.

The through-holes may be provided on different lines of longitude.

The second drum may further include a discharge hole provided at the upper side of the decompression unit to discharge wash water that has passed through the decompression unit upward.

The upper end of the second drum may be detachably coupled to the drum, and the upper end of the second drum may include a coupling portion coupled to the drum and a spacing portion spaced apart from the drum.

The discharge hole may be provided at the coupling portion.

The laundry treatment apparatus may further include a first water drainage path defined between the tub and the drum and a second water drainage path defined between the drum and the second drum, wherein the auxiliary may drop wash water to at least one of the first and second water drainage paths using the centrifugal force generated by the rotation of the second drum.

The discharge hole may be provided at the coupling portion.

The drum may include a balancer coupled to the coupling portion, and the second water drainage path may be formed by recessing one side of the inner circumferential surface of the balancer.

The second drum may include an auxiliary body to receive laundry and wash water and an auxiliary cover detachably provided at the auxiliary body and having a laundry introduction port through which laundry is introduced.

The cabinet may be provided in the upper surface thereof with an opening through which laundry is introduced.

The drum may include a first concave-convex unit provided in the inner circumferential surface of the drum, and the second drum may further include a second concave-convex unit provided in the outer circumferential surface of the second drum so as to engage with the first concave-convex unit.

The second drum may include a first rib protruding upward from the lower surface of the second drum and a second rib protruding from the inner circumferential surface of the second drum toward the inside of the second drum.

Advantageous Effects

The present invention has the effect of providing a laundry treatment apparatus including a second drum provided in a first drum so as to be rotatable with the first drum in order to wash laundry separately depending on the kind of laundry.

In addition, the present invention has the effect of providing a laundry treatment apparatus including an additional water supply device such that, in a structure in which wash water is supplied to a second drum and the wash water overflowing from the second drum is supplied to a first drum, laundry received in the first drum is prevented from being contaminated by the wash water overflowing from the second drum.

In addition, the present invention has the effect of providing a laundry treatment apparatus including a water supply device capable of simultaneously supplying wash water to a first drum and a second drum.

In addition, the present invention has the effect of providing a laundry treatment apparatus including a water drainage structure for draining wash water from a second drum, thereby preventing the loss of wash water.

In addition, the present invention has the effect of providing a laundry treatment apparatus including an upper water drainage structure provided at the upper end of a second drum, which is simpler in structure and lower in manufacturing cost than a lower water drainage structure provided at the lower end of the second drum.

In addition, the present invention has the effect of providing a laundry treatment apparatus including various water drainage paths for draining wash water from a second drum, thereby effectively preventing laundry received in a first drum from being contaminated.

In addition, the present invention has the effect of providing a laundry treatment apparatus including a water drainage path for draining wash water from a second drum to a first drum, in which case a lint filter is omitted from the second drum, thereby simplifying the laundry treatment apparatus and reducing the cost of manufacturing the laundry treatment apparatus.

In addition, the present invention has the effect of providing a laundry treatment apparatus including a fixing unit to fix a second drum provided in a first drum, thereby preventing noise from being generated from the second drum.

DESCRIPTION OF DRAWINGS

FIG. 2 is a view showing a water drainage unit of a second drum provided in the laundry treatment apparatus according to the present invention;

FIG. 3 is a view showing the second drum provided in the laundry treatment apparatus according to the present invention;

BEST MODE

Hereinafter, the present invention will be described in detail with reference to the accompanying drawings.

Figure 1:
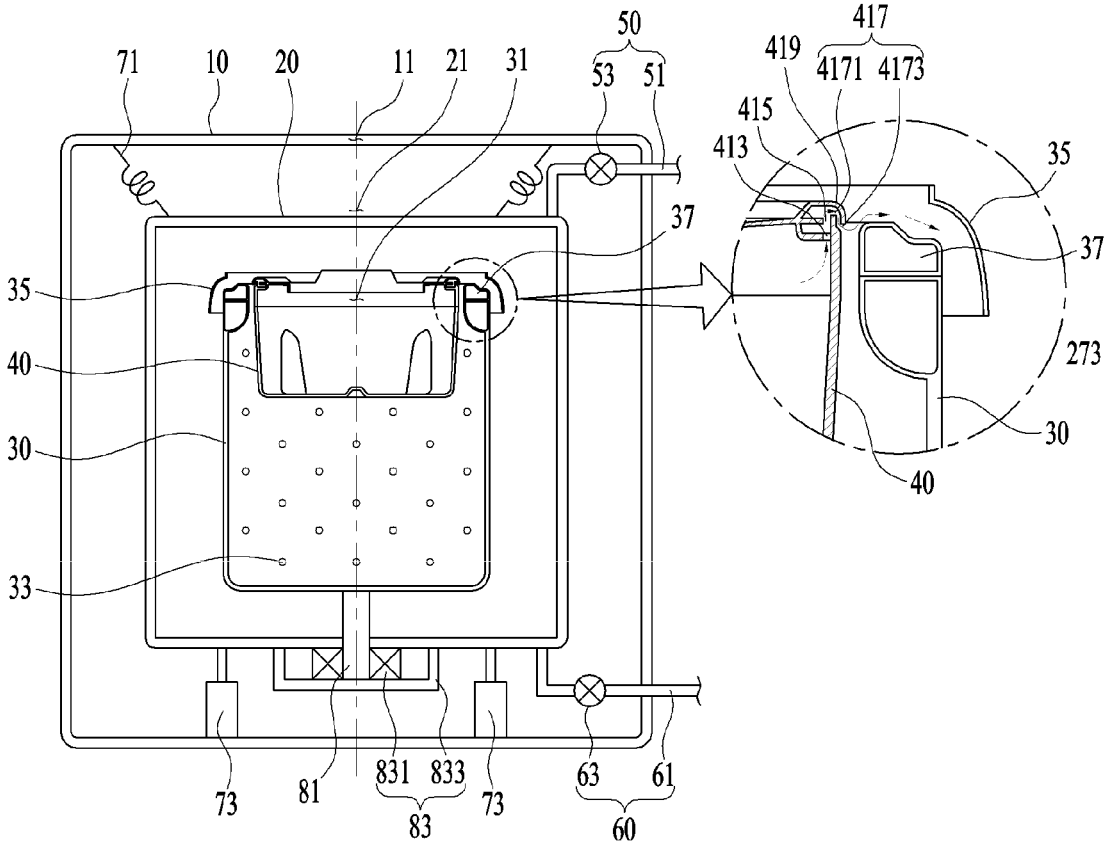
FIG. 1 is a view showing a laundry treatment apparatus according to an embodiment of the present invention.

FIG. 1 is a view showing a laundry treatment apparatus according to an embodiment of the present invention, and FIG. 2 is a view showing a water drainage unit of a second drum provided in the laundry treatment apparatus according to the present invention.

Referring to FIGS. 1 and 2, the laundry treatment apparatus as the illustrated example may include a cabinet defining an exterior appearance thereof, a tub 20 provided in the cabinet 10 to receive wash water, and a first drum 30 rotatably mounted in the tub to receive laundry.

The cabinet 10 may include a cabinet opening 11 provided in a certain side to allow the laundry to be loaded therein or unloaded therefrom.

The tub 20 may include a tub opening 21 provided on a certain side, corresponding to the cabinet opening 11, preferably, on the same line of longitude as the cabinet opening 11.

The first drum 30 may include a drum opening 31 for facilitating the laundry loading or unloading into the first drum 30 via the cabinet opening 11 and the tub opening 21.

The laundry treatment apparatus may further include a water supply unit 50 for supplying wash water to the tub 20 and a water drainage unit 60 for draining the wash water supplied to the tub 20 outside.

The water supply unit 50 may include a water supply hose 51 providing a flow path for guiding wash water to flow into the tub 20 from an external water supply source and a water supply valve 53 provided to control the amount of wash water supplied to the tub 20 via the water supply hose 51.

The water drainage unit 60 may include a water drainage hose 61 providing a flow path for guiding the wash water supplied to the tub 20 outside the laundry treatment apparatus and a water drainage valve 63 provided to control the amount of the wash water drained via the water drainage hose 61.

The first drum 30 is rotatable and configured to enhance washing efficiency when washing the laundry loaded in the first drum 30. The laundry treatment apparatus according to the present invention may include a driving unit 80 configured to rotate the first drum 30.

The driving unit 80 may include a shaft 81 transmitting a rotational force to the first drum 30 and a motor unit 83 supplying the rotational force to the shaft to rotate the first drum 30. The shaft 81 has one end integrally rotatable with the first drum 30 and the other end integrally rotatable with the motor unit 83, which will be described later.

The motor unit 83 may be provided as a general brushless DC (BLDC) motor used in the art to which the present invention pertains. More specifically, the motor unit 83 consists of a stator 831 generating a rotary magnetic field and a rotor 833 rotatably secured to an outer circumferential surface of the stator 831, with one end integrally rotatable with the shaft 81.

The laundry treatment apparatus according to the present invention may further include a vibration unit 70 for preventing the noise generated by the collision or vibration between the tub 20 and the cabinet 10 during the relative motion of the tub and the cabinet 10 when the vibration generated by the rotation of the first drum 30 is delivered to the tub 20.

The vibration unit 70 may include a first vibrating portion 71 made of an elastic material and a second vibrating portion 73 made of a damper material.

In the illustrated example, the first vibrating portion 71 is provided in an upper surface of the tub 20 and the second vibrating portion 73 is provided in a lower surface of the tub 20. That is briefly illustrated to describe the function of the vibration unit 71. As the user's need arises, the number and positions of the first and second vibrating portions 71 and 72 are changeable without limitation.

The first drum 30 may include a first drum cover 35 detachably coupled to a top surface of the first drum, a balancer 37 provided in one surface of the first drum to compensate for the unbalance generated by aggregation of the laundry inside the first drum 30, and a plurality of penetrating holes 33 provided in an outer circumferential surface of the first drum 30 to facilitate the loading or unloading of the laundry inside the first drum 30.

The second drum 40 may be further provided in the laundry treatment apparatus and the second drum 40 may be mounted in the first drum 30 to hold smaller-sized laundry pieces than the laundry pieces loaded in the first drum 30.

The second drum 40 may be detachable from the first drum 30 by the user as necessary.

Specifically, the second drum 40 may be removed when the user desires to wash laundry using only the first drum 30. The second drum 40 may be mounted in the first drum 30 to perform simultaneous washing as shown in FIG. 1 when the user desires to wash laundry using both the first drum 30 and the second drum 40.

When the second drum 40 is mounted in the first drum 30 for simultaneous washing, the wash water may be supplied to the first drum 30 and the second drum independently, which will be described below.

When only the first drum is used to perform washing, without the second drum 40 mounted in the first drum 30, the wash water is supplied not to the first drum 30 but to the tub 20 and the wash water may be supplied to the first drum 30 via the penetrating holes 33 provided in the first drum 30, like a conventional laundry treatment apparatus.

The second drum 40 may further include a second drum water drainage unit 41 for draining the water inside the second drum 40 to the tub.

The second drum water drainage unit 41 may include a collection portion 411 defining a certain space for collecting the wash water held in the second drum 40, an inlet hole 413 providing a certain space for collecting the wash water in the collection portion, an outlet hole 415 providing a certain space for discharging the wash water outside the collection portion 411, a slit 417 providing a certain space for discharging the wash water to the tub 20 from the outlet hole 415, and a cover 419 guiding the wash water to an area between the first drum cover 35 and the balancer 37 from the slit 417.

Only one collection portion 411 may be provided, or a plurality of collection portions 411 may be provided as an alternative example illustrated in the drawing.

More specifically, the plurality of the collection portions 411 may include a first collection portion 4111 collecting the wash water via the inlet hole 413 firstly and a second collection portion 4113 collecting the wash water via the outlet hole 415 secondly.

The wash water collected in the second collection portion 4113 may flow to the space between the first drum cover 35 and the balancer 37 through a first slit 4171 and a second slit 4173.

According to the principle of discharging the wash water outside from the second drum 40 through the collection portion 411 provided in an upper area, the second drum 40 is rotatable and the rotation speed of the second drum 40 rises to a preset RPM or more. When the rotation speed of the second drum 40 rises to the preset RPM or more, the wash water held in the second drum 40 may be made to flow to the collection portion 411 provided in the upper area along an internal surface of the second drum 40 by the centrifugal force of the drum.

If the rotation speed of the second drum 40 is a first RPM or more, the wash water may flow to the first collection portion 4111 but not to the second collection portion 4113. When the rotation speed of the second drum 40 is a second RPM set higher than the first RPM, the wash water flows to the second collection portion 4113 and then flows outside. Accordingly, there is an effect of preventing the loss of wash water.

To prevent the loss of the wash water more efficiently, the inlet hole 413 and the outlet hole 415 may be provided on different lines of longitude.

If the inlet hole 413 and the outlet hole 415 are provided on the same line of longitude, the wash water is likely to be discharged in an undesired situation and to be lost by inertia. Accordingly, the inlet hole 413 and the outlet hole 415 are provided in different lines of longitude to prevent the wash water from being lost by inertia such that the loss of the wash water can be prevented more efficiently and effectively.

Figure 4:
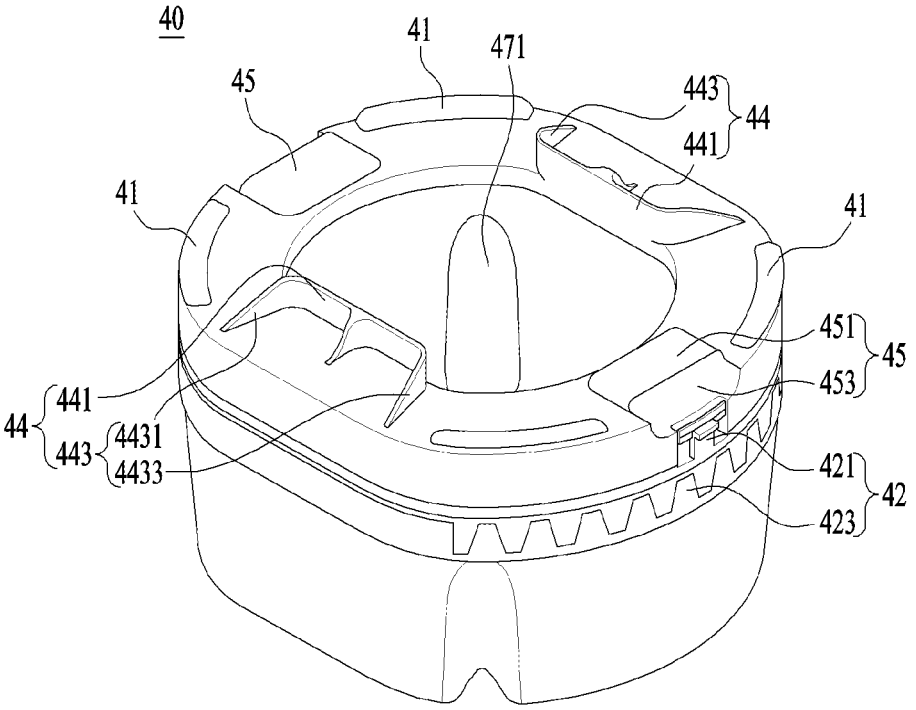
FIG. 4 is a view showing the second drum mounted in a first drum provided in the laundry treatment apparatus according to the present invention.
Figure 5:
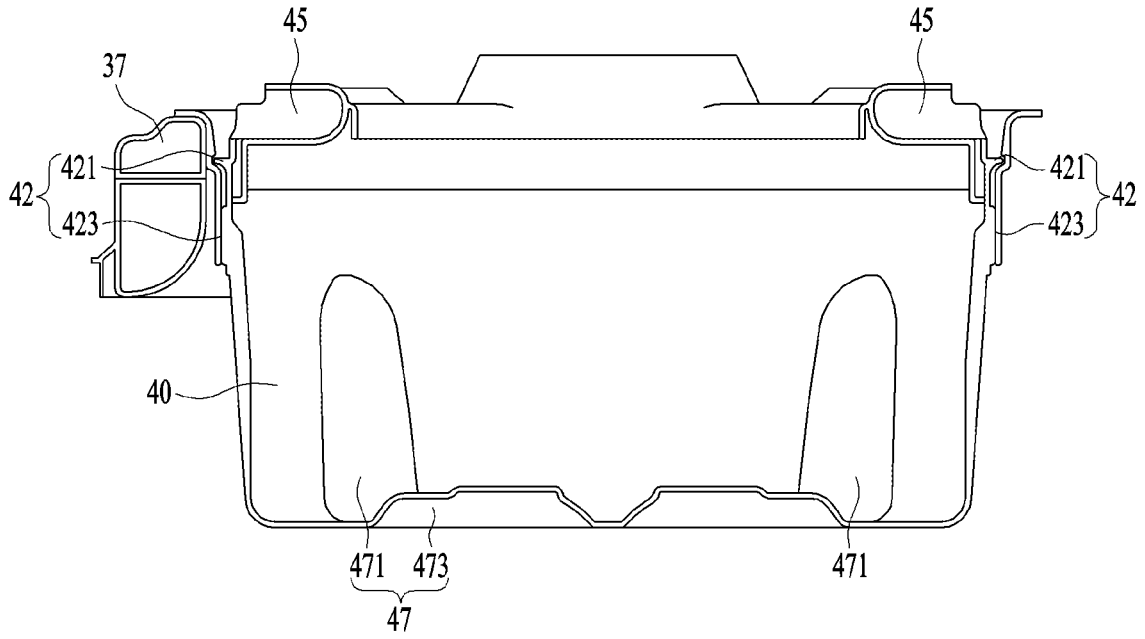
FIG. 5 is a view showing a fixing unit fixed to the second drum and the first drum provided in the laundry treatment apparatus according to the present invention.

FIG. 3 is a view showing the second drum provided in the laundry treatment apparatus according to the present invention, FIG. 4 is a view showing the second drum mounted in a first drum provided in the laundry treatment apparatus according to the present invention, and FIG. 5 is a view showing a fixing unit fixed to the second drum and the first drum provided in the laundry treatment apparatus according to the present invention.

Referring to FIGS. 3, 4 and 5, the second drum 40 may include the second drum water drainage unit 41 draining the wash water held in the second drum 40 as mentioned above; a fixing unit 42 fixing the second drum 40 to the first drum 30; a water supply path 43 provided to allow the wash water to flow to the first drum 30 through the second drum 40 when the second drum 40 is mounted in the first drum 30 to perform the simultaneous washing; a water supply guide 44 provided to facilitate water supply to the first drum; a handle unit 45 providing a certain space held by the user to facilitate the process of mounting or demounting the drum with respect to the first drum 30; and a rib unit 47 provided on an inner circumferential surface of the second drum to supplement the rigidity of the second drum 40 and to improve washing efficiency of the laundry held in the second drum 40.

Moreover, the second drum 40 comprises a body 48 receiving the laundry and a cover 46 provided at the upper end of the body.

The second drum 40 is fabricated with an open top side, to load or unload the laundry. It is preferred that a cross section of the top surface of the second drum 40, possessed by the second drum 40, be oval.

As illustrated in the drawing, the cross section of the first drum 30 is circular and the cross section of the second drum 40 is oval. This serves to form the water supply path 43 between the first drum 30 and the second drum 40 for the wash water to flow therebetween when the second drum 40 is mounted in the first drum 30.

As an illustrated example, the water supply path 43 may include a first water supply path 431 provided in an upper area of the cross section of the second drum and a second water supply path 433 provided in a lower area of the cross section of the second drum 40.

The number or shape of the water supply paths 43 may be changed by the user as necessary and is not limited to the illustrated examples, as long as the wash water is supplied to the first drum 30 through the second drum 40.

The fixing unit 42 is provided to fixedly secure the second drum 40 to the first drum 30. The fixing unit 42 may include a first fixing portion 421 is provided in a position which is as high as the balancer 37 of the first drum 30. The first fixing portion 421 has a hook structure, and there is an effect of preventing the second drum from moving vertically after being fixedly secured to the first drum 30.

Moreover, the fixing unit 42 may be provided in each of the ends of the second drum 40, preferably, at a position at which a line connecting centers of the two water supply paths 43 is perpendicular to a line connecting centers of the two fixing units 42 provided at both ends of the second drum 40.

The first fixing portion 421 is made of an elastic material and is provided at the same line of longitude as the handle unit 45, and it is preferred that the user simultaneously hold the handle unit 45 and apply a pressure to the first fixing portion 421.

The fixing unit may further include a second fixing portion 423 protruding to a preset height from an outer circumferential surface of the second drum 40 to prevent the second drum 40 from relatively moving in a right and left direction within the first drum 30 after the second drum 40 is fixedly mounted in the first drum 30.

As one example, the second fixing portion 423 may include a plurality of ribs formed in a plurality of rectangular shapes. Specifically, a cross section of a rib is rectangular. As another example, the second fixing portion 423 may include a plurality of ribs formed in a plurality of trapezoidal shapes. Specifically, a cross section of a rib is trapezoidal.

Preferably, the cross section of the second fixing portion 423 may be provided in the trapezoidal shapes. This has an effect of attenuating the noise generated by friction when the force generated by the relative motion between the first drum 30 and the second drum 40 is applied to the second drum 40.

The water supply guide 44 is provided to prevent the wash water supplied to the first drum from flowing into the second drum. When simultaneous washing is performed after the second drum 40 is fixedly mounted in the first drum 30 as mentioned above, the wash water supplied to the first drum 30 and the second drum 40 may be supplied by independent water supply means.

Accordingly, it is necessary to prevent the wash water intended to flow to the first drum from flowing to the second drum 40.

The water supply guide 44 may include a projecting portion 441 having a surface projecting upward to prevent the wash water from flowing to the second drum 40 and an inclined portion 443 inclined toward the projecting portion 441 to form both lateral surfaces of the water supply guide 44.

As illustrated in the drawing, the inclined portion 443 may include a first inclined portion 4431 provided in a left area to prevent the wash water from flowing leftwards and a second inclined portion 4433 provided in a right area to prevent the wash water from flowing rightwards.

However, the water supply guide 44 may be formed in a predetermined shape only if the wash water designed to flow to the first drum 30 is prevented from flowing to the second drum 40. The number and shape of the water supply guides 44 are not limited to the illustrated examples.

The handle unit 45 is provided to allow the user to mount or demount the second drum 40 in or from the first drum 30 while holding the second drum 40 in his/her hands. For this, the handle unit 45 may include a recessed portion 453 providing a certain space in which the user's hand is inserted and a top cover 451 providing a top surface of the recessed portion 453.

The top cover 451 defines the top surface of the recessed portion 453 and the length of the top cover 451 may be shorter than the horizontal length of the bottom surface of the recessed portion 453.

If the horizontal length of the top cover 451 is equal to or longer than that of the bottom surface of the recessed portion 453, the location of the handle unit 45 when the second drum 40 is inserted into and mounted in the first drum 30 is not sufficient between the first drum 30 and the second drum 40, and it is difficult for the user's hand to be inserted into the recessed portion 453 so as to hold the handle unit 45.

The rib 47 may include a first rib 473 protruding upward from a bottom surface of the second drum 40 and a second rib 471 protruding toward the center of the second drum from an inner lateral surface, in other words, an inner circumferential surface of the second drum 40. When the second drum 40 is rotated, the first rib 473 and the second rib 471 rotate the wash water using frictional force with the wash water held in the drum 40.

Hereinafter will be described the method of supplying the wash water to the first drum 30 and the second drum 40 independently in the case in which simultaneous washing is performed in the first drum 30 having the second drum 40 fixedly secured thereto.

First of all, to supply wash water to the first drum 30, the wash water is not supplied to the tub like a conventional laundry treatment apparatus but to the second drum 40.

The wash water reflected or guided by the water supply guide 44 provided in the second drum 40 may be supplied to the first drum via the water supply path 43 provided between the first drum 30 and the second drum 40.

The laundry treatment apparatus according to the present invention may further include a second water supply unit 29 to supply the wash water to the second drum 40.

The second water supply unit 29 may include a first water supply nozzle 291 and a second water supply nozzle 292 provided in one surface of the first drum to spray the wash water toward the second drum 40; a first branch hose 294 and a second branch hose 295 providing flow paths for the wash water toward the first water supply nozzle 291 and the second water supply nozzle 292; a branch junction pipe 293 provided to branch the wash water supplied from the outside to the first branch hose 294 and the second branch hose 295; and a valve control unit 296 controlling the amount of the wash water supplied to the first water supply nozzle 291 and the second water supply nozzle 292.

The amount of the wash water supplied to the second drum 40 may be controlled based on time, unlike the conventional laundry treatment apparatus.

More specifically, the amount of the wash water supplied from the first water supply nozzle 291 and the second water supply nozzle 292 per hour is fixed at a constant level and the amount of wash water supplied to the second drum 40 is estimated and controlled based on the supply time of the wash water.

For this, the valve control unit 296 may be provided as a device configured to supply a consistent amount of water regardless of water pressure, and the valve control unit 296 is well known to those skilled in the art to which the present invention pertains. Accordingly, details of the valve control unit 296 are omitted.

As one illustrated example, two water supply nozzles 291 and 292 for supplying wash water to the second drum 40 are provided and the number of water supply nozzles 291 and 292 is changeable by the user as necessary. The reason why the plurality of water supply nozzles 291 and 292 is provided is to supply the wash water to the second drum 40 in a very short time.

Accordingly, it is sufficient for the plurality of water supply nozzles 291 and 292 to be provided in order to accomplish the intended purpose. The number of water supply nozzles 291 and 292 is not limited to two as mentioned above in the illustrated example.

The water supply nozzles 291 and 292 may be controlled independently.

This improves the efficiency of washing if a small amount of laundry is loaded.

Hereinafter, a laundry treatment apparatus according to another embodiment of the present invention will be described with reference to FIG. 6. A duplicate description of components of the laundry treatment apparatus according to this embodiment that are identical to those of the laundry treatment apparatus according to the previous embodiment will be omitted.

Figure 6:
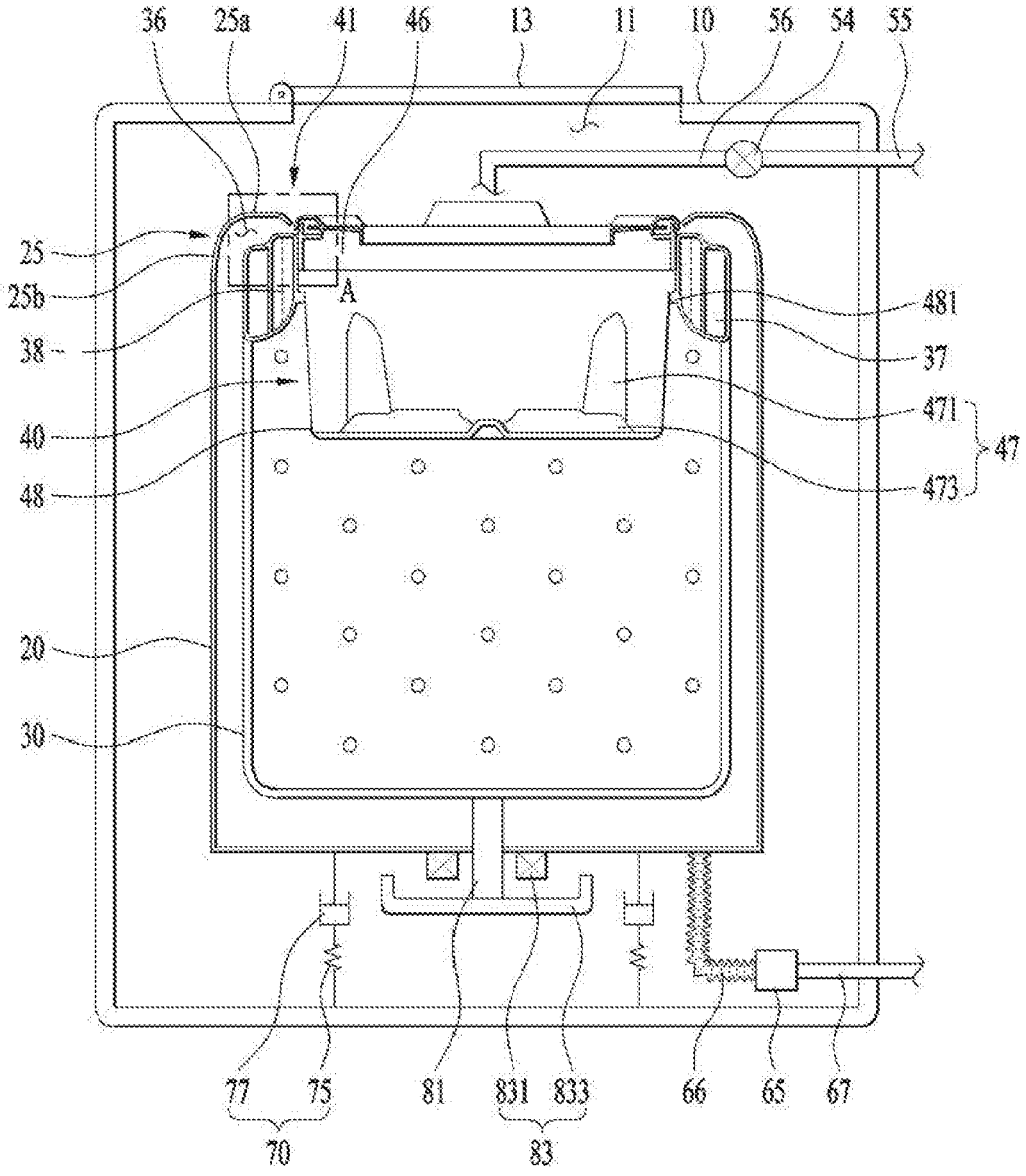
FIG. 6 is a view showing a laundry treatment apparatus according to another embodiment of the present invention.

FIG. 6 is a view showing a laundry treatment apparatus according to another embodiment of the present invention.

Referring to FIG. 6, the laundry treatment apparatus includes a cabinet 10 defining an exterior appearance thereof, a tub 20 provided in the cabinet 10 to hold wash water, a first drum 30 rotatably mounted in the tub 20 to hold laundry, a second drum 40 detachably provided in the first drum 30 to wash laundry in the state of being separated from the drum, and a first water drainage path 36 and a second water drainage path 38 to drain wash water from the second drum 40. The first drum 30 and the second drum 40 correspond respectively to the first drum 30 and the second drum of the laundry treatment apparatus according to the previous embodiment.

The cabinet 10 may include a cabinet opening 11 provided in one surface thereof to allow laundry to be loaded or unloaded therein and a door 13 to open and close the cabinet opening 11.

A water supply device for supplying wash water into the tub is connected to the upper side of the tub 20.

The water supply device includes a water supply valve 54 for controlling the amount of wash water supplied from an external water supply source, a first water supply pipe 55 having one end connected to the external water supply source and the other end connected to the water supply valve and configured to introduce wash water from the external water supply source to the water supply valve, and a second water supply pipe 56 having one end connected to the water supply valve 54 and the other end facing the tub 20 and configured to supply wash water to the tub 20.

A water drainage device for draining wash water is connected to the lower side of the tub 20.

The water drainage device includes a water drainage pump 65 to provide power to discharge wash water from the tub 20, a first water drainage pipe 66 having one end connected to the tub 20 and the other end connected to the water drainage pump 65 and configured to introduce wash water from the tub 20 to the water drainage pump 65, and a second water drainage pipe 67 having one end connected to the water drainage pump 65 and the other end exposed to the outside and configured to discharge wash water from the water drainage pump 65 out of the cabinet 10. The first water drainage pipe 66 may be a bellows pipe such that vibration from the tub 20 is not prevented from being transmitted to the water drainage pump 65.

The outer circumferential surface of the tub 20 is buffed and supported by a vibration unit 70. The vibration unit 70 is provided at the lower side of the tub 20 and includes a spring 75 and a damper 77 connected to the spring 75 in series and provided at the upper side of the spring. In FIG. 6, the spring 75 and the damper 77 are shown as being provided at the lower side of the tub 20 and being connected in series. However, the present invention is not limited thereto. The spring 75 may be variously configured. For example, the spring 75 may be connected to the upper side of the tub 20.

Meanwhile, the tub 20 includes a tub cover 25 detachably coupled to the upper end of the tub 20.

The tub cover 25 includes a bent cover portion 25*b* detachably provided at the upper end of the tub and bent to the inside of the tub 20 and a horizontal cover portion 25*a* extending from the bent cover portion 25*b* to the inside of the tub 20 and having an opening formed in the center thereof. A user may introduce laundry through the opening or may detach the second drum 40 from the first drum 30.

Meanwhile, the first water drainage path 36 is defined between the tub cover 25 and a balancer 37, which are spaced apart from each other. As will be described below, the first water drainage path 36 serves to drain wash water discharged from the second drum 40 to the tub 20.

Figure 7:
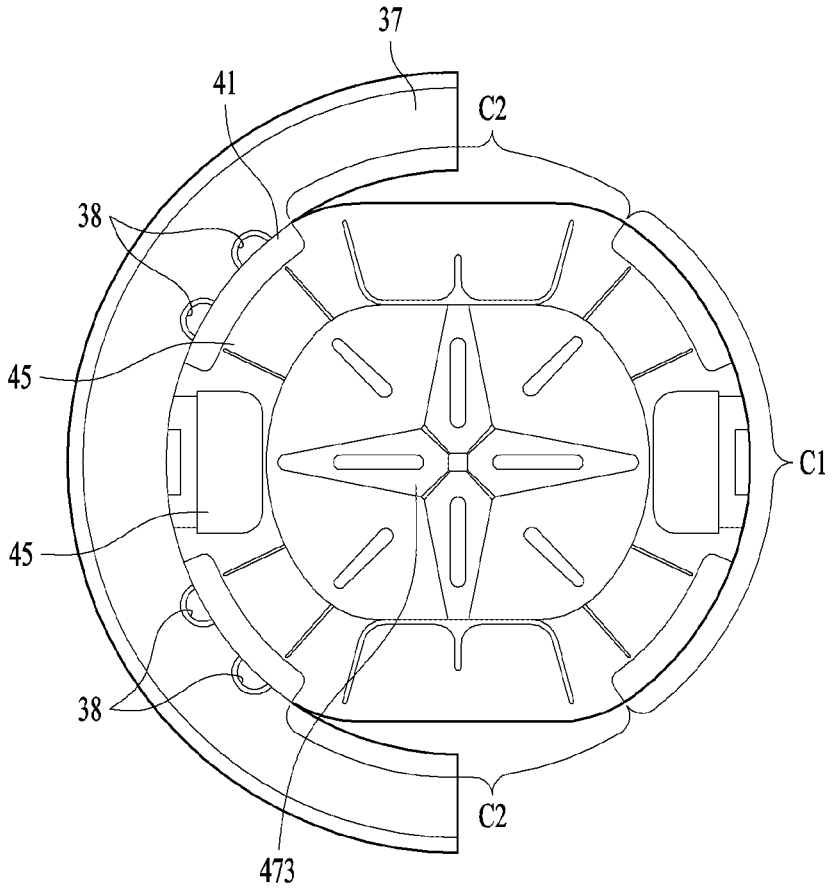
FIG. 7 is a plan view illustrating a second water drainage path shown in FIG. 6.

The second water drainage path 38 is defined between the first drum 30 and the second drum 40 and serves to drain wash water to the first drum 30. Hereinafter, the second water drainage path 38 will be described with reference to FIG. 7. FIG. 7 is a plan view illustrating the second water drainage path 38 shown in FIG. 6.

Referring to FIG. 7, the second water drainage path 38 is formed by recessing a portion of the inner circumferential surface of the upper end of the first drum 30, and extends to the lower side of the first drum 30. In the case in which the balancer 37 is provided at the upper end of the first drum 30, the second water drainage path 38 is formed by recessing a portion of the inner circumferential surface of the balancer 37. As will be described below, the second water drainage path 38 serves to drain wash water discharged from the second drum 40 to the first drum 30.

In the case in which the balancer 37 is a ball balancer, it is necessary to adjust the depth to which a portion of the inner circumferential surface of the balancer is recessed such that balls can smoothly move in the balancer 37.

Meanwhile, when the second drum 40 is rotated at a very high speed at a spin-drying step, some of the wash water discharged from the second drum 40 may scatter upward. The scattered wash water may move to the outside of the tub 20 to cause corrosion of components of the laundry treatment apparatus or breakage of electric parts of the laundry treatment apparatus.

Consequently, the laundry treatment apparatus may further include a scattering prevention unit 22 or 26 configured to prevent wash water discharged from the second drum 40 from scattering upward.

In addition, the laundry treatment apparatus may further include a scattered water collection unit 23 or 27 configured to collect the unscattered wash water and to guide the collected wash water to the second water drainage path 38.

The scattering prevention units 22 and 26 and the scattered water collection units 23 and 27 may be configured according to various embodiments. Hereinafter, the scattering prevention unit 22, which is provided at the tub cover 25, will be described with reference to FIGS. 8 and 9.

Figure 8:
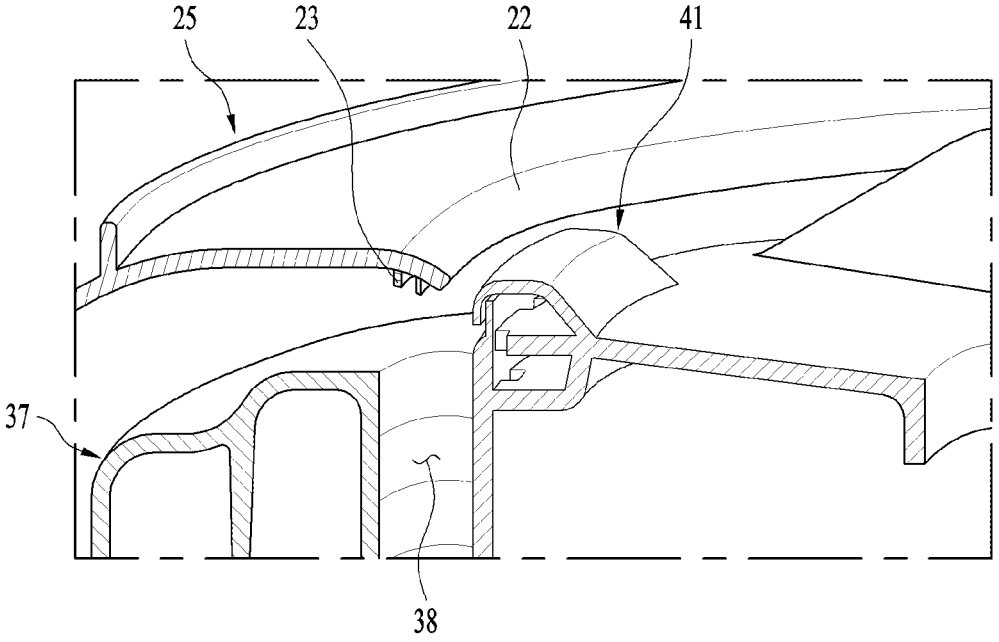
FIG. 8 is an enlarged view showing part A of FIG. 6.
Figure 9:
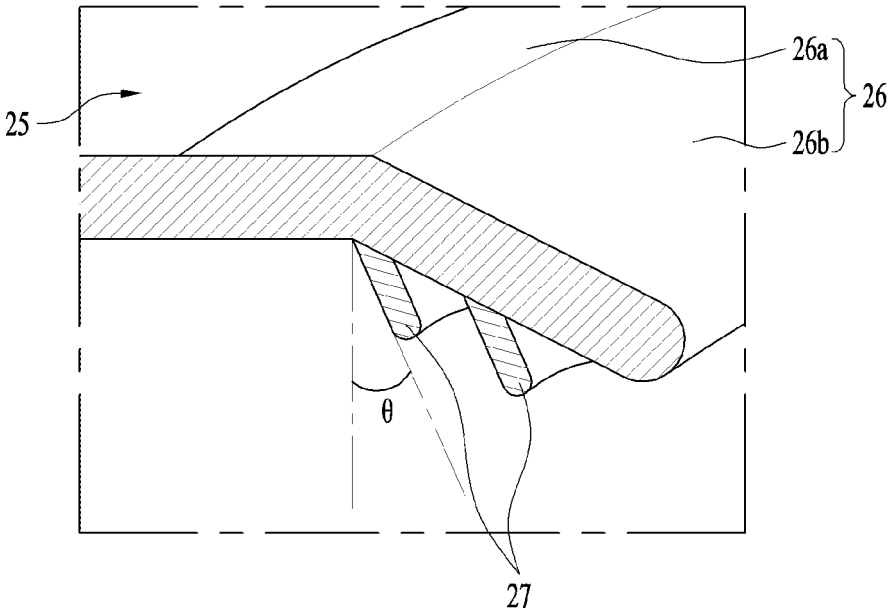
FIG. 9 is a view showing another embodiment of a scattering prevention unit and a scattered water collection unit.

FIG. 8 is an enlarged view showing part A of FIG. 6, and FIG. 9 is a view showing another embodiment of the scattering prevention unit and the scattered water collection unit.

Referring to FIG. 8, the scattering prevention unit 22 includes a curved surface that extends from the inner surface of the tub cover 25 toward the second drum 40 and is convex upward. Consequently, wash water discharged from the second drum 40 collides with the lower surface of the scattering prevention unit 22 and thus is prevented from scattering out of the tub 20.

Meanwhile, the scattered water collection unit 23 is provided at the lower surface of the scattering prevention unit 22 to guide wash water collected on the lower surface of the scattering prevention unit 22 to the second water drainage path 38. Specifically, the scattered water collection unit 23 extends downward from the lower surface of the scattering prevention unit 22 such that one surface of the scattered water collection unit 23 faces the second drum 40. For example, the scattered water collection unit 23 may be a rib that protrudes from the lower surface of the scattering prevention unit 22 and extends in the circumferential direction of the tub cover 25.

In the above description, the scattering prevention unit 22 collides with wash water to prevent the wash water from scattering, and the scattered water collection unit 23 guides the wash water collected by the scattering prevention unit 22 to the second water drainage path 38, which are principal functions thereof. In actuality, the scattered water collection unit 23 may also collide with wash water to prevent the wash water from scattering, and the scattering prevention unit 22 may also guide wash water to the second water drainage path 38.

Referring to FIG. 9, the scattering prevention unit 26 has a flat surface, rather than a curved surface. Specifically, the scattering prevention unit 26 includes a horizontal blocking portion 26*a* that extends horizontally from the tub cover 25 and an inclined blocking portion 26*b* that extends from the horizontal blocking portion 26*a* toward the second drum 40 and is inclined downward.

The scattered water collection unit 26 is provided at the lower surface of the inclined blocking portion 26*b* at a predetermined angle θ relative to the direction in which gravity is applied. The predetermined angle θ is set such that the scattered water collection unit 27 can more smoothly guide wash water to the second water drainage path 38.

Referring back to FIG. 6, the second drum 40 includes an auxiliary body 48 detachably coupled to the inner circumferential surface of the upper end of the first drum 30 to receive laundry and wash water and an auxiliary cover 46 detachably provided at the auxiliary body 48 and having a laundry introduction port through which laundry is introduced.

The upper end of the second drum 40 is detachably coupled to the inner circumferential surface of the balancer 37. More specifically, the upper end of the auxiliary body 48 is coupled to the inner circumferential surface of the balancer 37. The reason for this is that if the auxiliary cover 46 is coupled to the inner circumferential surface of the balancer 37, the auxiliary cover 46 and the auxiliary body 48 may not be securely coupled to each other due to the weight of the laundry received in the auxiliary body 48.

The upper end of the second drum 40 includes a coupling portion C1 coupled to the inner circumferential surface of the balancer 37 and a spacing portion C2 spaced apart from the balancer 37. In this specification, however, the coupling portion C1 and the spacing portion C2 are not limited to the upper end of the second drum 40. The reason for this is that the cross section of the second drum 40 is uniform from the upper end to the lower end. In this specification, therefore, the coupling portion C1 includes both the upper and lower parts of the portion indicated by C1 of FIG. 7, and the spacing portion C2 includes both the upper and lower parts of the portion indicated by C2 of FIG. 7. In this specification, therefore, each of the auxiliary cover 46 and the auxiliary body includes both the coupling portion C1 and the spacing portion C2. Meanwhile, in FIG. 7, the coupling portion C1 is shown as being located only at one side of the second drum 40, which is only for convenience in preparing the figure. Consequently, a pair of coupling portions C1 is provided so as to be opposite each other. A pair of spacing portions C2 is also provided so as to be opposite each other.

Meanwhile, in FIG. 7, the spacing portion C2 is shown as being flat. However, the present invention is not limited thereto. In other words, the spacing portion C2 may be curved, whereby the cross section of the second drum 40 may be generally formed in an oval shape. Consequently, the coupling portion C1 may be a first curvature portion C1 having a first curvature, and the spacing portion C2 may be a second curvature portion C2 having a second curvature, which is smaller than the first curvature.

Meanwhile, the first curvature portion C1 may be referred to as a long-distance portion C1, and the second curvature portion C2 may be referred to as a short-distance portion C2.

In the above structure, the second drum 40 may make wash water flow in eddies, thereby further increasing washing force.

The auxiliary cover 46 includes a second drum water drainage unit 41 to drain wash water using centrifugal force generated by the rotation of the second drum 40. A description of the auxiliary container water drainage unit 41 shown in FIG. 8, will be omitted in order to avoid a duplicate description thereof.

Hereinafter, various embodiments of the second drum water drainage unit will be described with reference to FIGS. 10 to 13. FIGS. 10 to 13 are views showing various embodiments of the second drum water drainage unit.

Figure 10:
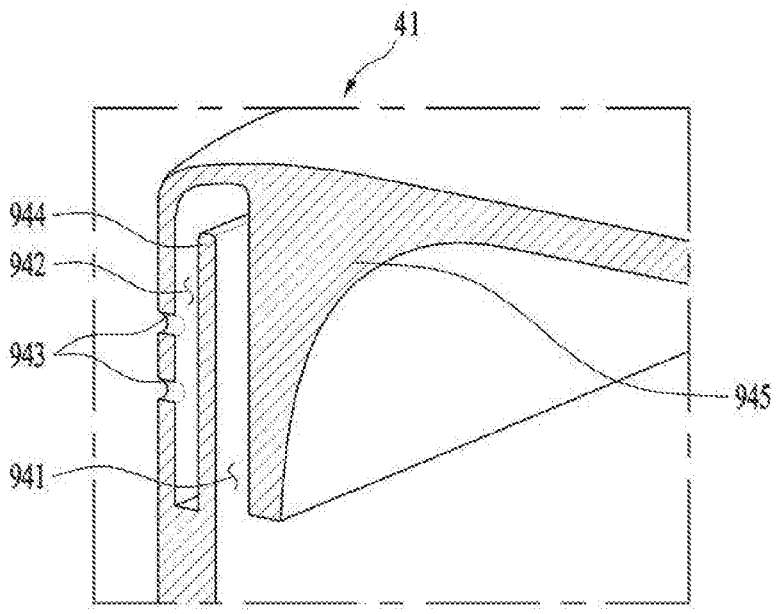
FIGS. 10 to 13 are views showing various embodiments of a second drum water drainage unit.

Referring to FIG. 10, a second drum water drainage unit 41 according to another embodiment of the present invention includes a discharge hole 943 formed at the auxiliary cover 46 to discharge wash water received in the auxiliary body 48 upward and a decompression unit formed at the auxiliary cover 46 to decompress wash water before the wash water is discharged to the discharge hole 943.

The discharge hole 943 is provided at the upper side of the decompression unit, and is formed in the shape of an outlet hole formed in the circumferential surface of the upper end of the auxiliary body 48. The discharge hole 943 is provided at the coupling portion C1, i.e. the long-distance portion C1, to which the centrifugal force generated by the rotation of the second drum 40 is most strongly applied. Since wash water moves to the highest position along the inner circumferential surface of the coupling portion C1 at the same rotational speed, the wash water may be more easily discharged.

The decompression unit is provided at the lower side of the discharge hole 943 to decompress wash water that moves upward along the inner circumferential surface of the coupling portion C1. That is, the decompression unit disturbs the flow of wash water, whereby wash water received in the second drum 40, which rotates at a uniform rotational speed, is prevented from being discharged from the second drum.

For example, when the second drum 40 rotates at a rotational speed for performing a washing cycle, wash water is prevented from being discharged from the second drum 40. The reason for this is that if wash water flows along the inner circumferential surface of the second drum and is discharged outside via the discharge hole 943 when the second drum 40 performs the washing cycle, the washing cycle is not performed any longer. Consequently, the decompression unit reduces the water pressure of the wash water that moves upward along the inner circumferential surface of the auxiliary body 48, whereby the wash water is prevented from being discharged at the rotational speed at which the washing cycle is performed, and the wash water is discharged at a rotational speed at which a spin-drying cycle is performed.

As shown in FIG. 10, the decompression unit includes a rising flow path 941 to move wash water upward and a falling flow path 942 to downwardly move the wash water that has moved upward. Specifically, the rising flow path 941 and the falling flow path 942 are defined by a water wall 944 provided in a space between the circumferential surface of the auxiliary cover 46 and a cover projecting portion 945 extending downward from the lower surface of the auxiliary cover 46 and also extending upward. Consequently, one surface of the water wall 944 defines one side of the rising flow path, and the other surface of the water wall 944 defines one side of the falling flow path 942.

Wash water moves upward along the rising flow path 941 and then moves downward along the falling flow path 942. At this time, the water pressure of the wash water decreases. In other words, the rising flow path 941 and the falling flow path 942 disturb the smooth flow of wash water.

Meanwhile, the falling flow path 942 may be narrower than the rising flow path 941 in order to further decompress wash water. In addition, the sectional areas of the rising flow path 941 and the falling flow path 942 may be reduced along the direction in which wash water flows.

The discharge hole 943 is formed at the other side of the falling flow path 942 so as to communicate with the falling flow path 942. Consequently, wash water may be discharged to the outside while moving along the falling flow path 942.

Figure 11:
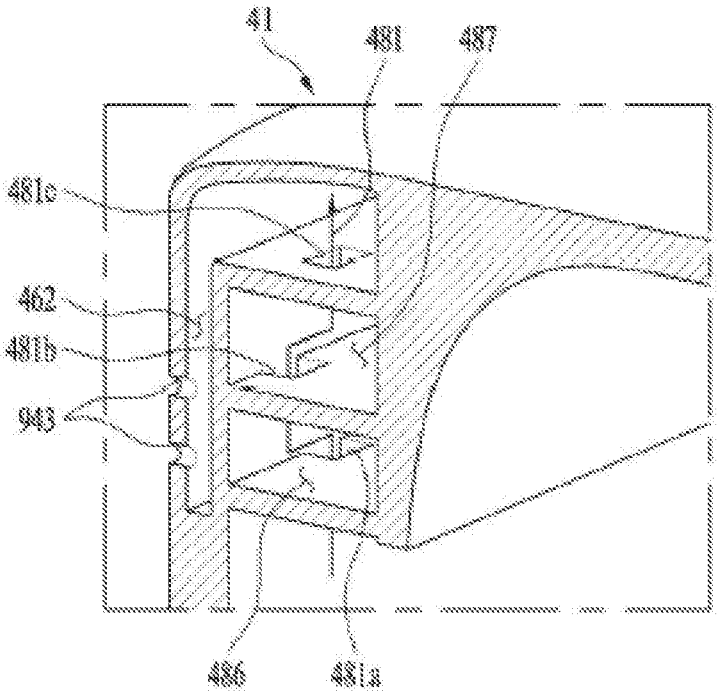

Referring to FIG. 11, a second drum water drainage unit 41 according to another embodiment of the present invention is different from 46 the second drum water drainage unit 41 shown in FIG. 10 in that a rising flow path constituting a decompression unit is provided with a plurality of collection portions and a plurality of through-holes through which the collection portions communicate with each other. Due to the differences, the water pressure of wash water is further reduced when the wash water passes through a rising flow path 481. Hereinafter, the differences will be described.

Specifically, the rising flow path 481 includes a lower collection portion 486 provided at the lower part of the rising flow path 481, an upper collection portion 487 provided at the upper part of the rising flow path 481, a first through-hole 481*a* to introduce wash water to the lower collection portion 486, a second through-hole 481*b* through which the lower collection portion 486 and the upper collection portion 487 communicate with each other, and a third through-hole 481*c* through which the upper collection portion 487 and a falling flow path 462 communicate with each other.

Wash water is introduced into the falling flow path 462 sequentially via the first through-hole 481*a*, the lower collection portion 486, the second through-hole 481*b*, the upper collection portion 487, and the third through-hole 481*c*, which are provided at the rising flow path 481.

In order to decompress wash water while the wash water passes through the rising flow path 481, the first through-hole 481*a* and the second through-hole 481*b* are provided on different lines of longitude, and the second through-hole 481*b* and the third through-hole 481*c* are provided on different lines of longitude. The first through-hole 481*a* and the third through-hole 481*c* are provided on the same line of longitude or different lines of longitude.

In addition, the volume of the upper collection portion 487 may be smaller than that of the lower collection portion 486 in order to more effectively decompress wash water.

In FIG. 11, the decompression unit is shown only for the lower collection portion 486 and the upper collection portion 487, which, however, is merely an example. A plurality of collection portions may be further provided at the lower side of the lower collection portion 486, and a plurality of collection portions may be further provided at the upper side of the upper collection portion 487. In addition, unlike what is shown in FIG. 11, the decompression unit may include a single lower collection portion 486 and a plurality of upper collection portions 487 arranged in the circumferential direction and vice versa.

Meanwhile, the second drum 40 must rotate at a first RPM such that wash water received in the second drum 40 is introduced into the lower collection portion 486 of the decompression unit of the second drum water drainage unit 41.

In addition, the second drum 40 must rotate at a second RPM such that wash water received in the second drum 40 is introduced into the upper collection portion 487 of the decompression unit of the second drum water drainage unit 41.

The first RPM may be in a range of 60 rpm to 100 rpm, more specifically 80 rpm to 100 rpm.

The second RPM may be in a range of 100 rpm to 150 rpm, more specifically 100 rpm to 120 rpm.

Meanwhile, some of the wash water collected in the lower collection portion 486 by simple spin drying performed during a washing cycle or a rinsing cycle that has not moved to the upper collection portion 487 may move to the upper collection portion 487 by the centrifugal force generated by the rotation of the second drum even at a rotational speed lower than the first RPM.

Figure 12:
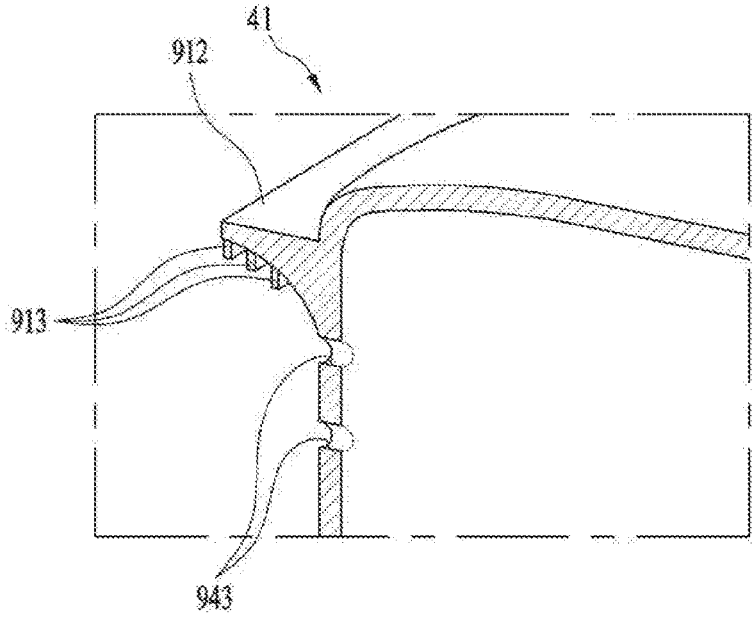

Referring to FIG. 12, a second drum water drainage unit 41 according to another embodiment of the present invention includes no decompression unit. The second drum water drainage unit 41 includes a discharge hole 943 including outlet holes formed in the circumferential surface of the auxiliary cover 46, an auxiliary scattering prevention unit 912 provided at the upper side of the discharge hole 943 to prevent wash water discharged from the discharge hole 943 from scattering upward, and an auxiliary scattered water collection unit 913 to guide the scattered water collected at the lower surface of the auxiliary scattering prevention unit 912 to the second water drainage path 38.

The lower surface of the auxiliary scattering prevention unit 912 may be inclined upward toward the outside of the auxiliary cover 46, which, however, is merely an example. The lower surface of the auxiliary scattering prevention unit 912 may be variously configured. For example, the lower surface of the auxiliary scattering prevention unit 912 may be horizontal.

The auxiliary scattering prevention unit 912 is provided at the lower surface thereof with an auxiliary scattered water collection unit 913 that collects the scattered water collected at the lower surface of the auxiliary scattering prevention unit and guides the collected water to the second water drainage path 38. The auxiliary scattered water collection unit 913 includes at least one rib provided at the lower surface of the auxiliary scattering prevention unit 912 and extending downward. In FIG. 12, the rib constituting the auxiliary scattered water collection unit 913 is shown as extending downward in the direction of gravity. However, the present invention is not limited thereto. The rib may be inclined downward toward the outside or the inside of the auxiliary cover 46 in consideration of the size of the auxiliary scattering prevention unit 912 and the location of the second water drainage path 38.

Figure 13:
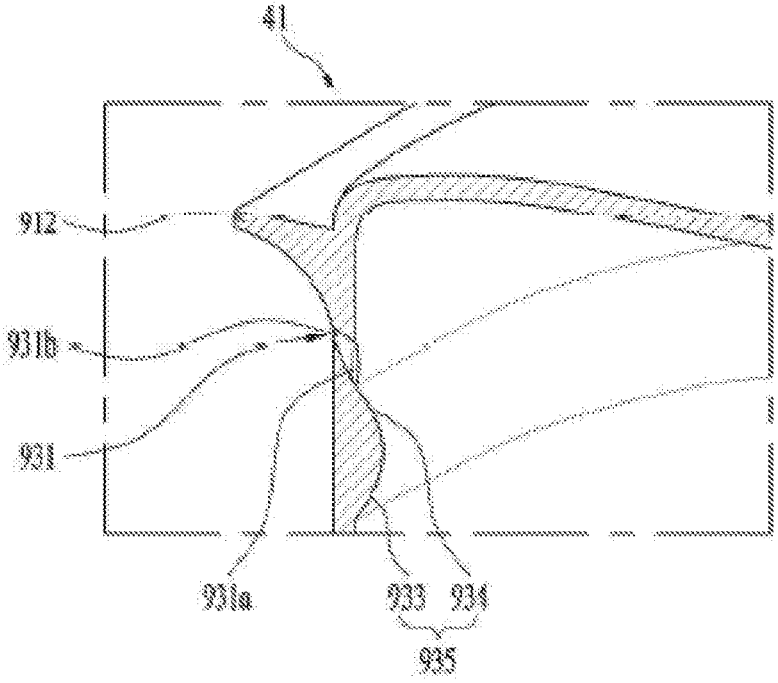

Referring to FIG. 13, a second drum water drainage unit 41 according to a further embodiment of the present invention includes a nozzle unit 931 formed at the circumferential surface of the auxiliary cover 46, an auxiliary scattering prevention unit 912 provided at the upper side of the nozzle unit 931, and an inclined portion 935 provided at the lower side of the nozzle unit 931.

The nozzle unit 931 is provided so as to be higher than the upper end of the balancer 37 and to be lower than the horizontal cover portion 25*a*, and includes at least one outlet hole formed through the upper end of the second drum 40, i.e. the circumferential surface of the auxiliary cover 46. The nozzle unit 931 is used to spray wash water to a desired position.

Specifically, the nozzle unit 931 includes a nozzle inlet port 931*a* formed in one side thereof to introduce wash water and a nozzle outlet port 931*b* formed in the other side thereof to discharge the introduced wash water and configured to be smaller than the nozzle inlet port. Consequently, the nozzle unit 931 may move wash water a relatively long distance. In this embodiment, the nozzle unit 931 is used to discharge wash water to the first water drainage path 36, which is distant from the second drum 40, rather than to the second water drainage path 38.

Specifically, the nozzle unit 931 is provided at the circumferential surface of the auxiliary cover 46, and the inclination angle of the nozzle unit 931 is adjusted to discharge wash water toward the inner surface of the tub cover 25. Specifically, the inclination angle of the nozzle unit 931 is adjusted to discharge wash water toward the lower surface of the horizontal cover portion 25*a*.

In particular, the angle at which the nozzle unit 931 discharges wash water is adjusted such that the incidence angle of wash water on the lower surface of the horizontal cover portion 25*a* is an acute angle. Since the amount of wash water that scatters due to collision between the wash water and the lower surface of the horizontal cover portion 25*a* when the wash water is incident on the lower surface of the horizontal cover portion 25*a* is small, therefore, most of the wash water may be guided to the tub 20 along the first water drainage path 36.

The auxiliary scattering prevention unit 912 is provided at the upper side of the nozzle unit 931 and protrudes from the outer circumferential surface of the auxiliary cover 46. The auxiliary scattering prevention unit 912 prevents wash water discharged from the nozzle unit 931 from scattering upward. A description of the auxiliary scattering prevention unit 912 is a duplicate of the description given with reference to FIG. 12, and therefore a detailed description thereof will be omitted.

Meanwhile, the second drum water drainage unit 41 drains wash water to the first water drainage path 36, and therefore does not include the scattered water collection unit 23 that guides wash water to the second water drainage path 38.

The inclined portion 935 is provided at the lower side of the nozzle unit 931 and protrudes from the inner circumferential surface of the auxiliary body 48 such that wash water is introduced toward the nozzle unit 931 while maintaining a predetermined inclination angle. When wash water passes through the nozzle unit 931, therefore, the resistance that may be generated in the nozzle unit 931 may be minimized, whereby the pressure in the nozzle unit 931 may be further increased. When the pressure in the nozzle unit 931 is increased, wash water may be sprayed strongly, whereby the wash water may be discharged to a desired position.

In addition, the inclined portion includes a first inclined portion 933 extending in the circumferential direction of the auxiliary body 48 and inclined upward toward the inside of the second drum 40 and a second inclined portion 934 connected to the upper end of the first inclined portion 933 and inclined upward toward the outside of the auxiliary body 48.

Consequently, the flow of wash water may be impeded by the first inclined portion 933. Since the flow of wash water is accelerated by the second inclined portion 934, however, the flow of wash water impeded by the first inclined portion 933 may be restored.

Meanwhile, in the case in which the nozzle unit 931 is provided at the second drum 40, the scattered water collection unit 23 is not provided at the tub cover 25. The reason for this is that the nozzle unit 931 is configured to discharge wash water to the first water drainage path, as described above.

The above detailed description illustrates the present invention. In addition, the forgoing describes exemplary embodiments of the present invention. The present invention may be used in various different combinations, changes, and environments. That is, variations or modifications can be made within the conceptual scope of the present invention, equivalents to the disclosure of the present invention, and/or the scope of technology and knowledge in the art that the present invention pertains. The embodiments describe the best mode for realizing the technical concept of the present invention, and variations required for the concrete application and use of the present invention are possible. Therefore, the above detailed description does not limit the present invention disclosed above. In addition, the appended claims should be interpreted to include other embodiments.

The invention claimed is:

1. A laundry treatment apparatus comprising:

a cabinet defining an exterior appearance thereof;

a tub provided in the cabinet to receive wash water;

a drum rotatably provided in the tub such that a shaft of the tub is perpendicular to a ground, the drum being configured to receive a first load of laundry;

a balancer provided along a circumferential surface of an upper end of the drum; and a second drum detachably provided in an upper part of the drum so as to be rotatable with the drum, the second drum being configured to wash a second load of laundry separate from the first load of laundry, wherein the second drum comprises:

a body configured to receive laundry and wash water;

a second drum cover detachably provided at an upper part of the body, the second drum cover having an introduction port through which laundry is introduced; and a second drum water drainer formed at the second drum cover to discharge wash water received in the body to a water drainage path defined between the tub and the drum using centrifugal force generated by rotation of the second drum, wherein the second drum water drainer comprises:

a plurality of collection portions each comprising:

a first collection portion and a second collection portion, the plurality of collection portions each defining at least one space configured to collect wash water from the second drum;

an inlet hole through which wash water is introduced into the first collection portion;

an outlet hole through which the wash water introduced into the first collection portion through the inlet hole is introduced into the second collection portion;

a cover configured to guide the wash water collected in the second collection portion to an area between a first drum cover and the balancer; and a slit located between the cover and the body and configured to discharge the wash water collected in the second collection portion, wherein the inlet hole is formed in a lower part of the first collection portion, the outlet hole is formed between the first collection portion and the second collection portion, and the slit is formed in an upper part of the second collection portion.

2. The laundry treatment apparatus according to claim 1, further comprising a tub cover provided at an upper part of the second drum cover and an upper end of the tub to guide wash water discharged from the second drum water drainer to the water drainage path.

3. The laundry treatment apparatus according to claim 2, wherein the second drum is detachably provided at an inner circumferential surface of the upper end of the drum.

4. The laundry treatment apparatus according to claim 3, wherein the second drum is detachably coupled to the balancer.

5. The laundry treatment apparatus according to claim 1, wherein wash water is prevented from being discharged through the second drum water drainer when the second drum is rotated at a first RPM for a washing cycle, and wash water is allowed to be discharged through the second drum water drainer when the second drum is rotated at a second RPM for a spin-drying cycle, which is higher than the first RPM.

6. The laundry treatment apparatus according to claim 5, wherein the inlet hole and the outlet hole are provided on different lines of longitude.

7. The laundry treatment apparatus according to claim 1, wherein a cross section of the drum is formed in a circular shape and a cross section of the second drum is formed in an oval shape, and the second drum comprises:

a coupling portion coupled to an inner circumferential surface of the drum; and a spacing portion spaced apart from the inner circumferential surface of the drum.

8. The laundry treatment apparatus according to claim 7, wherein the coupling portion of the second drum is coupled to an inner circumferential surface of the balancer and the spacing portion of the second drum is spaced apart from the inner circumferential surface of the balancer.

9. The laundry treatment apparatus according to claim 8, wherein the spacing portion has a smaller curvature than the coupling portion.

10. The laundry treatment apparatus according to claim 8, wherein the spacing portion defines a water supply path configured to supply wash water into the drum from an upper part of the drum.

11. The laundry treatment apparatus according to claim 10, wherein the second drum is provided with a water supply guide configured to prevent wash water supplied to the drum from being supplied into the second drum.

12. The laundry treatment apparatus according to claim 11, wherein the water supply guide comprises:

a projecting portion projecting upward so as to provide a surface configured to prevent wash water supplied to the drum from moving into the second drum; and an inclined portion formed at two opposing sides of the projecting portion to prevent the wash water from moving from side to side.

13. The laundry treatment apparatus according to claim 7, wherein the second drum water drainer is provided at the coupling portion.

14. The laundry treatment apparatus according to claim 13, wherein a plurality of second drum water drainers are provided at the coupling portion.

15. The laundry treatment apparatus according to claim 14, further comprising:

a handle provided at each end of a major axis of the second drum having the oval shape, wherein each handle has a second drum water drainer formed at a left and a right side thereof.

16. The laundry treatment apparatus according to claim 15, further comprising:

a fixing unit comprising a hook configured to fix the second drum to the drum, wherein the fixing unit is provided at each end of the major axis of the second drum having the oval shape.

17. The laundry treatment apparatus according to claim 1, further comprising a second water drainage path defined between an inner circumferential surface of the drum and the second drum to allow wash water discharged from the second drum water drainer to be introduced into the drum.

18. The laundry treatment apparatus according to claim 17, wherein the second water drainage path is formed by recessing a portion of the inner circumferential surface of the balancer.

* * * * *